US006305454B1

(12) United States Patent
Judkins et al.

(10) Patent No.: US 6,305,454 B1
(45) Date of Patent: Oct. 23, 2001

(54) VENETIAN TYPE BLIND HAVING PIVOT SLAT AND TILTING SLAT

(76) Inventors: Ren Judkins, 46 Newgate Rd.; Ludwig Nicholas Ross, 39 Center Ave., both of Pittsburgh, PA (US) 15202

( * ) Notice: Subject to any disclaimer, the term of this patent is extended or adjusted under 35 U.S.C. 154(b) by 0 days.

(21) Appl. No.: 09/551,503

(22) Filed: Apr. 17, 2000

(51) Int. Cl.[7] ..... E06B 3/32
(52) U.S. Cl. ..... 160/115; 160/113
(58) Field of Search ..... 160/115, 113, 160/168.1 R, 176.1 R

(56) References Cited

U.S. PATENT DOCUMENTS

| | | | |
|---|---|---|---|
| 7,108 | | 6/1850 | Bohrer . |
| 12,695 | | 4/1855 | Rose . |
| 330,936 | | 11/1885 | Sorlie . |
| D. 372,828 | | 8/1996 | Sticker . |
| 2,089,464 | * | 8/1937 | Wood . |
| 2,214,539 | | 9/1940 | Reinike . |
| 2,276,425 | * | 3/1942 | Slattery . |
| 2,283,640 | | 5/1942 | Kwon . |
| 2,579,485 | * | 12/1951 | Ferguson et al. . |
| 2,719,586 | | 10/1955 | Graham . |
| 2,757,726 | | 8/1956 | Rice et al. . |
| 2,836,237 | | 5/1958 | Hogin et al. . |
| 2,928,461 | * | 3/1960 | Barrett . |
| 2,979,127 | * | 4/1961 | Brown . |
| 3,111,164 | | 11/1963 | Lombard . |
| 4,940,070 | | 7/1990 | Warden . |
| 5,205,335 | | 4/1993 | Horton et al. . |
| 5,443,108 | | 8/1995 | LeVert et al. . |
| 5,485,874 | | 1/1996 | Whitmore ..... 160/115 |
| 5,573,051 | | 11/1996 | Judkins . |
| 6,123,137 | * | 9/2000 | Levert . |

FOREIGN PATENT DOCUMENTS

| | | | |
|---|---|---|---|
| 485353 | | 7/1952 | (CA) . |
| 3506 | * | 11/1872 | (GB) ..... 160/115 |
| 5096 | * | 4/1988 | (GB) ..... 160/115 |

* cited by examiner

*Primary Examiner*—Blair M. Johnson
(74) *Attorney, Agent, or Firm*—Buchanan Ingersoll, P.C.

(57) ABSTRACT

A venetian type blind has a bottomrail, a headrail positioned above the bottomrail, a pivot slat positioned between the headrail and the bottomrail and a tilt slat located immediately below the pivot slat. A set of upper ladders extends from the headrail to the pivot slat and carries a set of upper slats. A set of lower ladders extends from the bottomrail to the tilt slat with each lower ladder being connected to a pivot member on the pivot slat. The lower ladders carry a set of lower slats. At least one pivot cord connects the pivot slat to the tilt slat. This arrangement allows the lower slats to be separately tilted to a different position from the upper slats.

15 Claims, 5 Drawing Sheets

FIG. 8
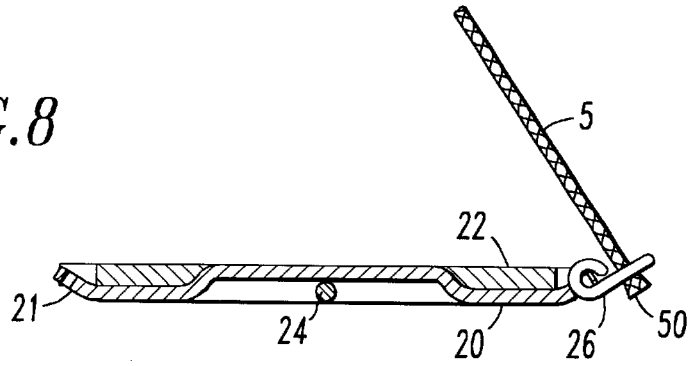
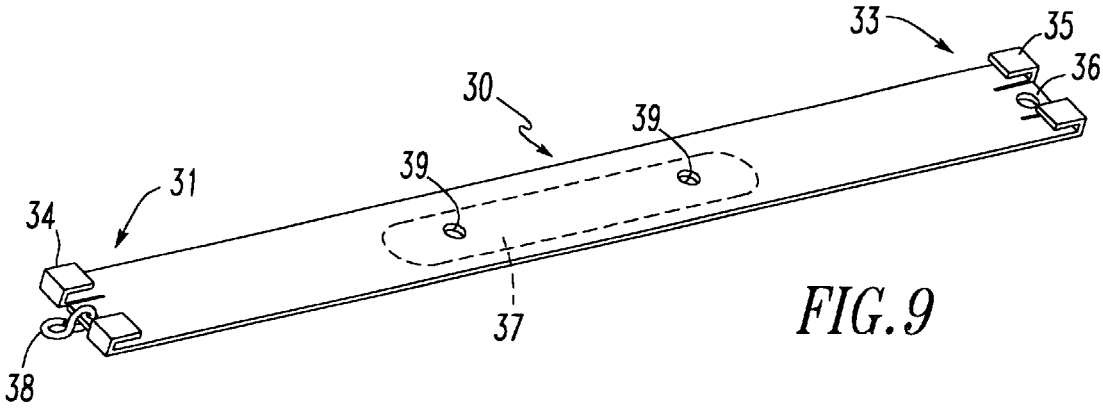
FIG. 9
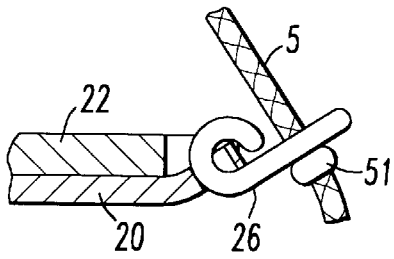
FIG. 10
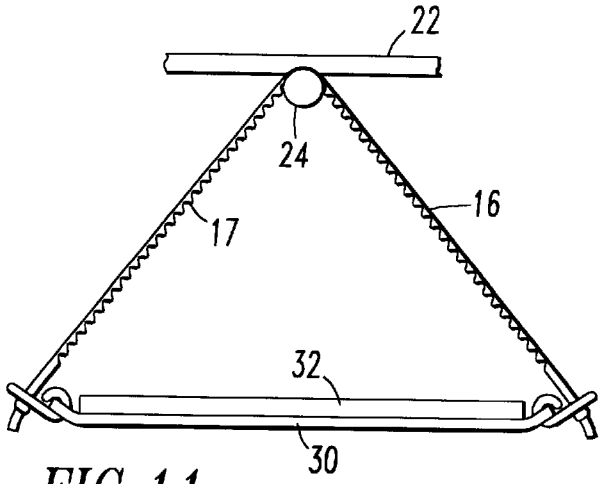
FIG. 11

VENETIAN TYPE BLIND HAVING PIVOT SLAT AND TILTING SLAT

FIELD OF INVENTION

This invention relates to venetian type blinds which can have slats that can be tilted from an open horizontal position to a closed tilted position and further can have groups of slats tilted at different angles.

BACKGROUND OF THE INVENTION

Venetian blinds consist of a plurality of horizontal slats. These slats rest on ladders made of cord, fabric tape, or flexible sheets of sheer material. Blinds have a headrail and bottomrail, the bottomrail being either one solid rail or two parallel rails connected by a cord. The blinds have a lift cord or cords, traditionally connected from the bottomrail through route holes in the slats, to a lift mechanism or cord lock in the headrail. In some venetian blinds the lift cords are placed proximate to the front and rear edges of the slats, and tiny notches or slots are made in the slats for the lift cords to pass through from the bottomrail into the headrail. Blinds are raised to stack slats at the top by pulling the lift cords through a cord lock, which locks into place by pulling the lift cords laterally to catch the lock and then back to set the lock. Alternatively, an axle driven cord collection system may be used for one or more sets of lift cords in place of a cord lock. In this type of blind, as in most venetian blinds, when the blind is lowered all of the slats can be in an open, horizontal position, or in a closed tilted position or some intermediate position. The blind cannot have one portion that is open and another portion which is closed unless the owner turns the slats individually. Yet, there has been a demand for other types of window coverings in which the upper half of the window is uncovered while the lower half of the window is covered. This feature allows the consumer to look out the top of the window with a clear view to the outside without having intense sunlight on the furniture and people that are ordinarily adjacent the lower half of the window. It also affords privacy to the people inside the building wherever ground level is lower than the window.

One type of blind which has been offered to meet this demand is the so-called bottom-up blind. In this type of blind the slats are stacked on the bottomrail, which typically rests adjacent the sill and has lift cords which run up to the headrail. A moving rail is placed on top of the slats and is connected to lift cords which run through the headrail. Pulling the lift cords raises moving rail and the slats from the bottomrail. Examples of this type of blind are disclosed in U.S. Pat. Nos. 7408 to Bohrer, 12,695 to Rose, 2,223,640 to Kwon and U.S. Pat. No. 5,443,108. to Levert et al. These blinds tend to be very bulky and can be awkward to operate because the moving rail is constantly changing position relative to the operator. Also, the two sets of lift cords are confusing. None of these blinds allows some of the slats to be in an open horizontal position while other slats are in a closed tilted position.

Laborda et al. in U.S. Pat. Nos. 2,116,356, Graham in 2,719,856 and Ewing in 2,427,266 disclose blinds in which the lower set of slats can be titled to a position different from the upper set of slats. All of these blinds have full length ladders that extend from the headrail to the bottomrail. Tilt cords are attached to the rear rails of the ladders at a point between the headrail and the bottomrail. Pulling the tilt cords moves the lower portion of the rear ladder rails relative to the front ladder rails tilting the lower slats. These blinds are more expensive to make and the additional tilt cords attached to the ladder rail detract from the appearance of the blind and require a means in the headrail and descending to the operator to tilt the lower portion. Again, the double headrail controls are often confusing and the lower slats are limited in the angles that they can be tilted. Finally, titling these blinds can actually shorten their length which compromises the desired features of privacy. Consequently, there is a need for a venetian blind which has separately tilting slat sections, but does not require additional cords and/or controls. Ideally, this blind will require a minimum of additional hardware and have the appearance of an ordinary blind. Also the blind should be able to utilize cord ladders, fabric tape ladders, or sheer material sheet ladders. Overall, there is still a need for an easily operated, neat-looking venetian type blind with several cording style options wherein the upper slats can be open while the lower slats are closed, or vice-versa, or some intermediate combination.

SUMMARY OF THE INVENTION

We provide a venetian type blind that has a bottomrail, a headrail positioned above the bottomrail, a pivot slat positioned between the headrail and the bottomrail and a tilt slat located immediately below the pivot slat. A set of upper ladders extends from the headrail to the pivot slat and carries a set of upper slats. A set of lower ladders extends from the bottomrail to the tilt slat with each lower ladder being connected to a pivot member on the pivot slat. The lower ladders carry a set of lower slats. This arrangement allows the lower slats to be separately tilted to a different position from the upper slats.

To change the lower slats to a position different from the upper slats an operator turns the tilt slat or the bottomrail. Since the rails of the lower ladder are attached to the tilt slat this will cause the front rail and the rear rail of each lower ladder to move in opposite directions causing the lower slats which are carried on the lower ladder to change position. The tilting slat thereby enables the user to place the blind in any of the extreme positions when the blind is fully or partially lowered. All of the slats may be in a closed position front edges down or back edges down; all of the slats may be in an open position; the slats on the upper ladders may be open while the slats on the lower ladders may be closed with front or back edges down; and the slats on the upper ladders may be closed with front or back edges down while the slats on the lower ladders may be open. To simplify the explanation only the extreme tilt positions are described, but any of the intermediate positions can be used in various combinations.

The ladders are typically made of cord, but the hardware of this blind will also accommodate fabric tape or sheet ladders. The lift cords can run along the edges of the slats or pass through route holes in the slats.

There are several distinct advantages of this Venetian type blind which set it apart from those attempted earlier. All of the components except the pivot slat and the tilt slat are off the shelf items that are used in existing venetian blinds. Furthermore, the pivot slat and the tilt slat can easily be made by modifying existing slats. Therefore, this blind can be used for all types of existing venetian type blinds. One could make this blind by simply modifying two of the slats in a prior art venetian blind to be the pivot slat and the tilt slat and cutting the ladders at the location of the pivot slat to form upper ladders and lower ladders. To make this type of blind, a manufacturer will not need to produce or purchase a new and expensive hardware system or components that need to be color matched. This is a very large consideration because venetians typically come in over 100 colors. Furthermore, this type of blind can be made with standard equipment that every blind maker should have. The blind is installed in the same manner as existing venetian type blinds.

Other objects and advantages of this venetian type blind will become apparent from the description of certain present preferred embodiments thereof which are shown in the drawings.

DESCRIPTION OF THE FIGURES

FIG. 8 is a sectional view taken along the line VIII—VIII in FIG. 7 with one ladder cord added.

FIG. 9 is a perspective view of a present preferred cord guide which is attached to the tilting slat.

FIG. 10 is a side view of a ladder link showing an alternative means of attaching the ladder rail.

FIG. 11 is a side view of an alternative embodiment which uses a strap to connect the tilt slat to the pivot slat.

DETAILED DESCRIPTION OF THE PREFERRED EMBODIMENTS

Figure 1:
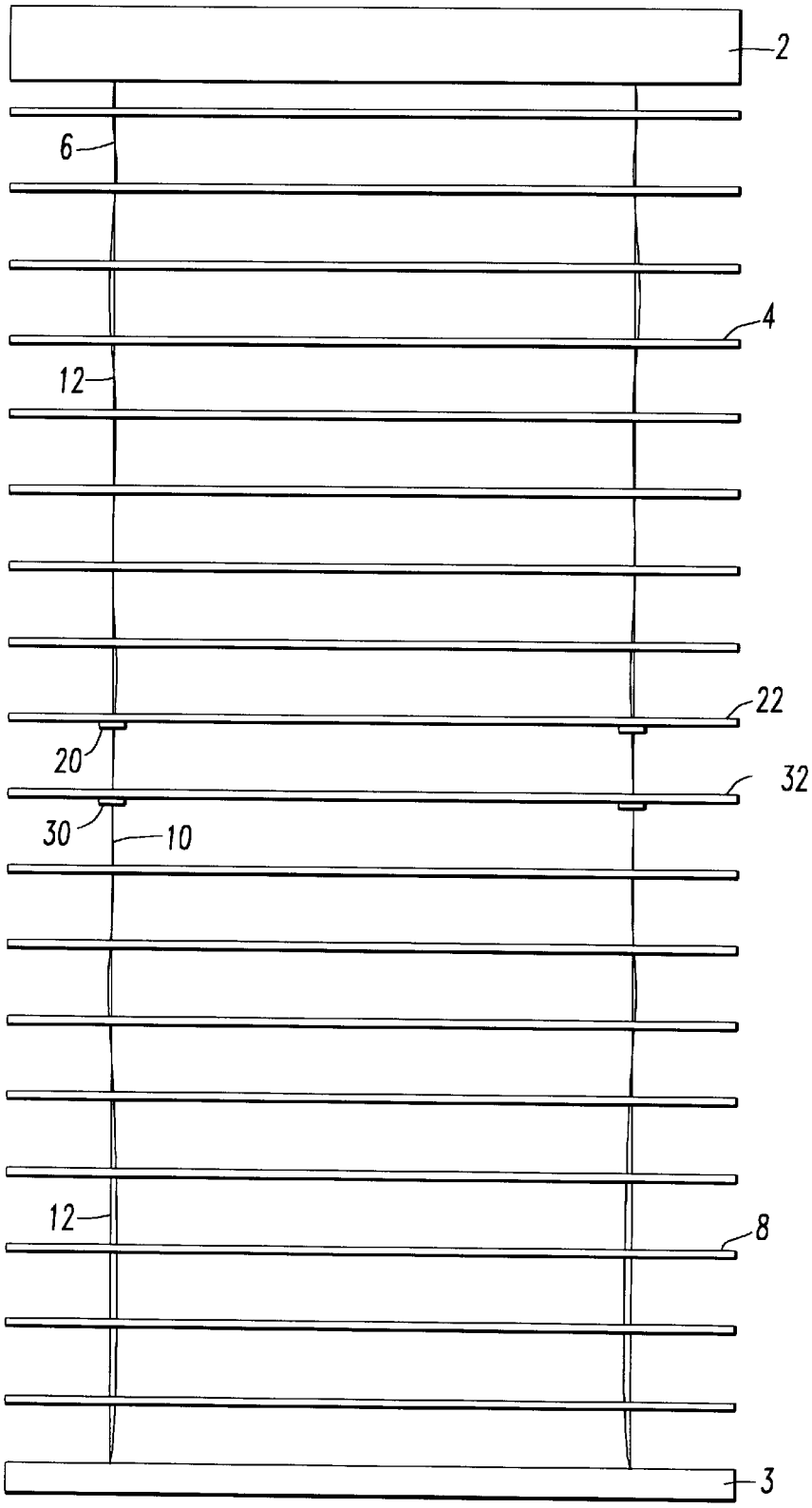
FIG. 1 is a front view of the present preferred embodiment of the venetian type blind shown in a fully lowered, fully open position.
Figure 2:
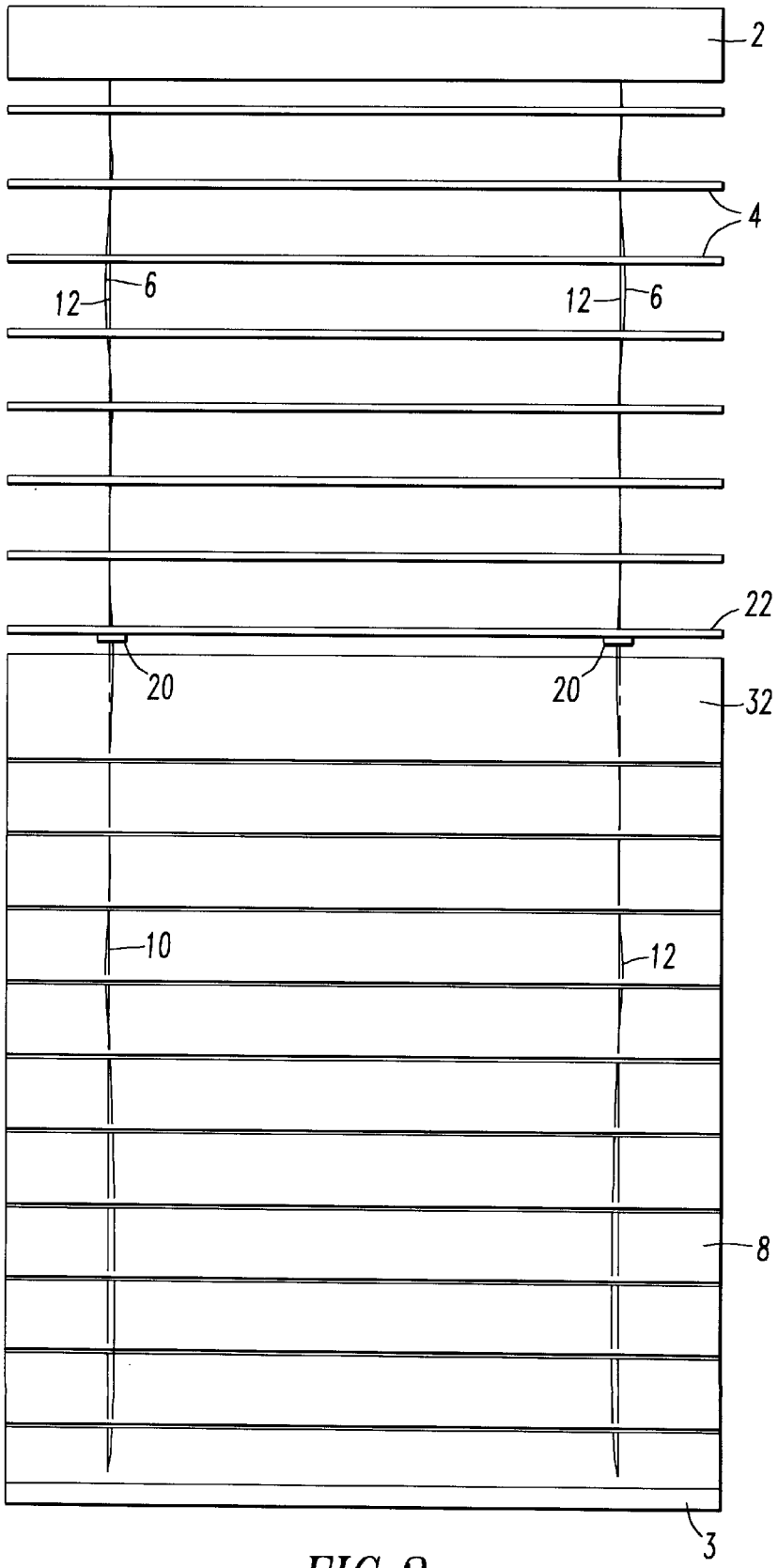
FIG. 2 is a front view similar to FIG. 1 showing the blind when it is in a fully lowered position with the upper slats open and the lower slats in a closed position back edges down.

Referring to FIGS. 1–5 a present preferred embodiment of the venetian blind 1 has a conventional headrail 2 which contains a tilt mechanism (not shown) and a conventional bottomrail 3 with slats 4 and 8 positioned between the headrail and the bottomrail. There is an upper set of slats 4 which are hung on a set of upper ladders 6 each having a front rail 5 and a rear rail 7. The rails of the ladders are shown in broken line to distinguish the ladder rails from the lift cords 12. The upper ladders extend from the tilt mechanism in the headrail 2 to a connector member 20 attached to a pivot slat 22. The lower ends of the upper ladders 6 are flexibly fastened to the connector member 20. The connector member may be a single body having a connector at each end as shown in the drawings, may be a simple eye bolt, or may be molded as part of the slat. In a present preferred embodiment shown in FIG. 8 a link 26 is provided at each end of the connector to which a ladder rail is attached. As shown in FIG. 8 the link fits through a hole 21 in the end of the connector. Then the ladder rail 5 or 7 is tied to the link or preferably the end of the cord may be retained in the link by enlarging the end 50 of the cord as shown in FIG. 10. This can be done either by heating and mushrooming the end 50 as shown in FIG. 8 or by attaching a bead 51 or other stop device to the end of the cord as shown in FIG. 10.

Figure 6:
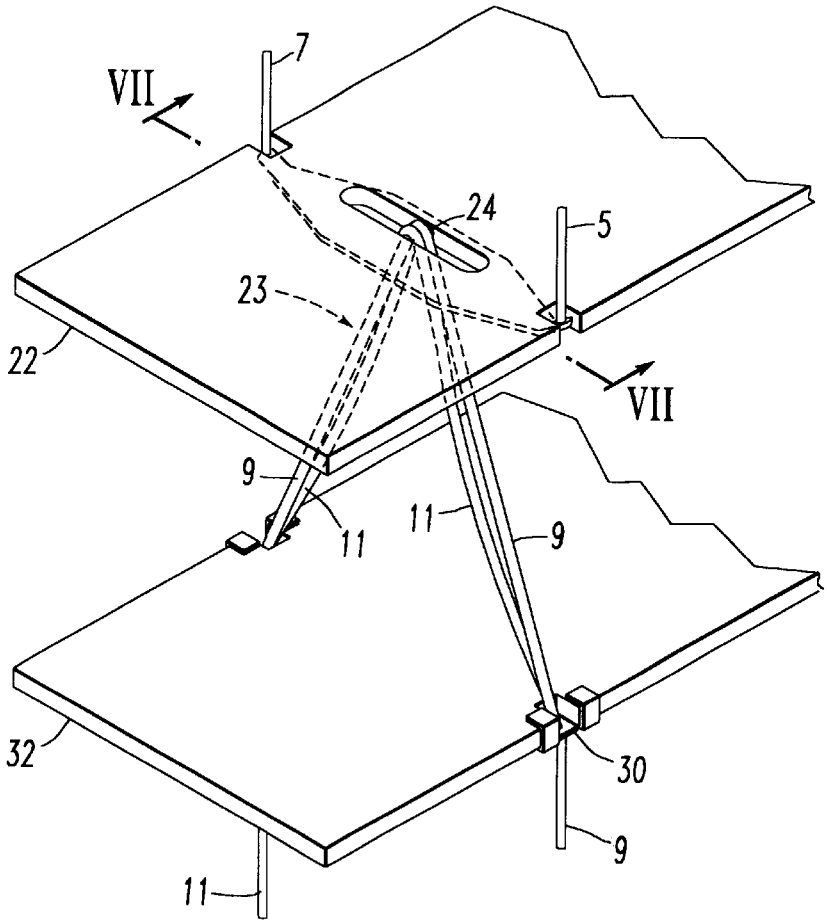
FIG. 6 is a perspective view of one end of the pivot slat and the tilt slat.

A set of lower ladders 10 carry the lower slats 8. Each connector member 20 has a center pivot pin 24 over which preferably the front rail 9 and the rear rail 11 of lower ladders 10 pass to form a pivoting connection. It is not necessary for the rails of the lower ladders to pass over the pivot point. It is only necessary that they be connected to the edges of the tilt slat. A separate member also attached to the edges of the tilt slat can pass over the pivot point. It is preferable for the member to collapse when the blind is stacked. In an alternative embodiment shown in FIG. 11, we provide a strap or belt 16, like a timing belt, having detents 17 along its length. The pivot pin 24 fits within a selected detent to easily tilt the blind to desired angles. In the present preferred embodiments, the upper ends of the front rail 9 and the rear rail 11 of the lower ladders 10 are tied to opposite ends of a second connector member 30 which is attached to a tilt slat 32 to form a pair of pivot cords 23. As can be seen in FIGS. 6 and 9 the second connector member 30 can be a metal stamping in which tabs 34 and 35 are cut. The tabs may be bent over the edges of the tilt slat to hold the connector member in place. Holes 39 may be provided in the second connector member 30 to attach it to the tilt slat by screws or rivets. Preferably, a strong adhesive could also be used to attached the connector members 20 and 30 to the pivot slat 22 or the tilt slat 32. We prefer to provide a link in each hole 36 left after the tab 34 or 35 is bent. The link 38 serves as a connector and permits one ladder rail to pass through and a second ladder rail to be fastened to the link. The bottom of the lower ladders are attached to the bottomrail 3. It should be apparent from FIG. 6 that the upper ends of the rails of each lower ladder could be tied to connector member 30 without passing over the pivot pin 24, and a separate cord could be run over the pivot pin and be attached to the opposite ends 31 and 33 of the second connector member 30. In the preferred embodiment the pivot pin is attached to the connector member 20, but this is not necessary. The pivot pin could be a separate piece or formed as part of the pivot slat or connected separately to the pivotal slat. In the embodiment shown in the drawings each upper ladder is co-linear with a lower ladder. However, the upper ladders could be spaced apart a different distance than the lower ladders.

Figure 7:
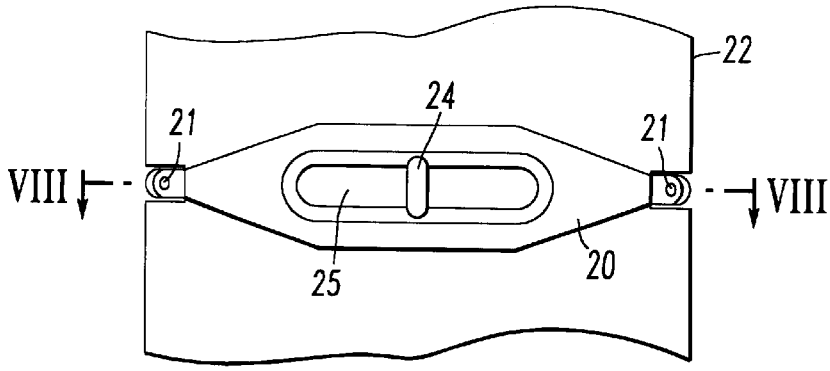
FIG. 7 is a fragmentary view taken along the line VII—VII in FIG. 6 showing the bottom of the pivot slat and a present preferred pivot member without any cords.

Lift cords 12 extend from the bottomrail 3 along the edges of the slats and into the headrail 2. In the figures the lift cords 12 are drawn as loosely hanging from the headrail. This is done to easily distinguish the ladder rails 5, 7, 9, and 11 from the lift cords. In practice however, the lift cords would rarely be loose. The lift cords may be collected on an axle within the headrail or pass out of the headrail through a cord lock (not shown). Hence, the lift cords are operated in the conventional manner. The lift cords could be routed through holes located in the center or near the edges of the slats. The ladders 6 and 10 preferably are cord ladders. When center lift cords are used a slot 37 shown in dotted line in FIG. 9 is cut in the lower ladder connector 30. Also, the region 25 of upper ladder connector 20 shown in FIG. 7 is open to allow passage of a lift cord. If desired, cord ladders could be replaced with fabric tape ladders or sheets of flexible material.

The number of ladders and lift cords may vary according to the width of the blind. For illustration purposes the blind is shown with nine upper slats, a pivot slat, a tilt slat and eight lower slats. There may be, but need not be, an equal number of upper slats and lower slats. The total number of slats will, of course, be dependent upon the length of the blind. Any number of slats, most likely more than are shown, will be used. The slats shown are symmetric to a horizontal plane passing through the front and back edges of the slat and are symmetric to a vertical plane between the front and back edges of the slats. Other types of slats, such as crowned, s-shaped, or asymmetrical slats, may be used instead of the flat slats.

No specialized hardware is needed, because the lifting and tilting mechanisms consist of hardware common to venetian type blinds. Indeed, an existing venetian blind can be easily modified to create the present blind by simply adding the tilt slat and the pivot slat. The pivot slat and tilt slat can be created by modifying a conventional slat. All other parts of the blind can be the same parts that are currently used in venetian type blinds now available in the marketplace.

Figure 3:
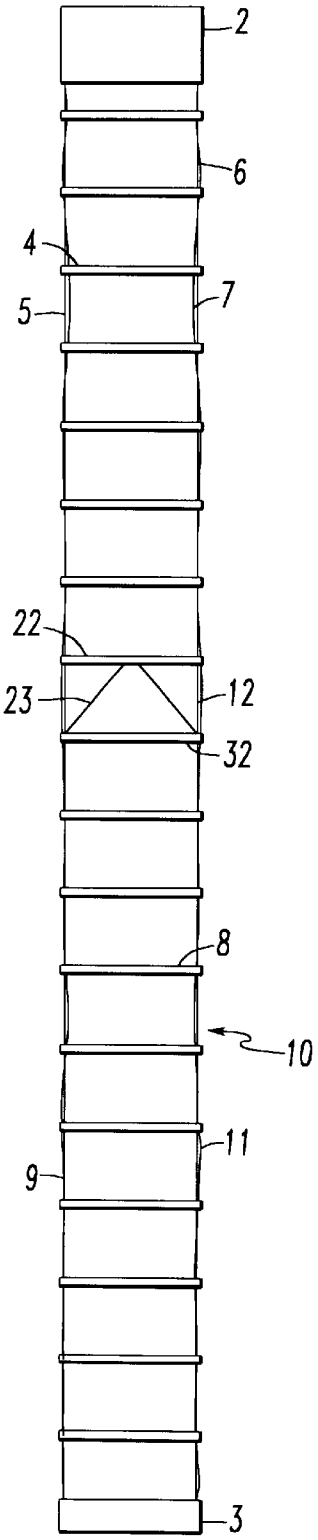
FIG. 3 is an end view of the blind in the fully lowered, fully open position shown in FIG. 1.
Figure 4:
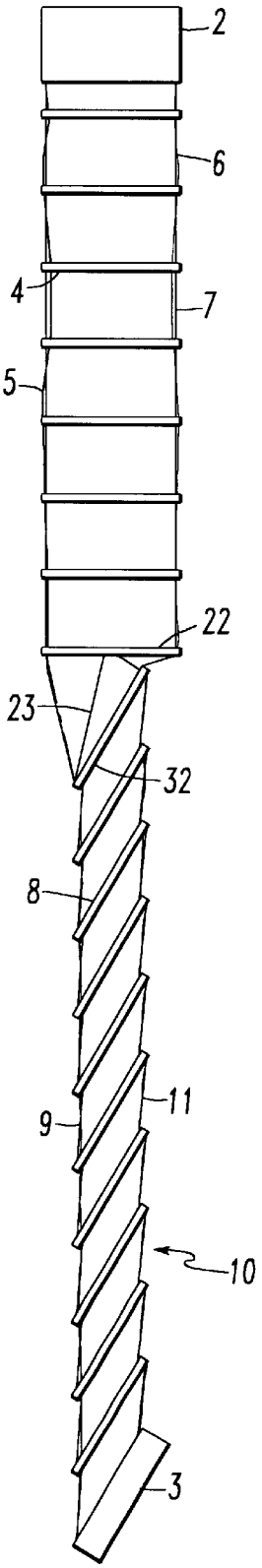
FIG. 4 is an end view showing the blind when it is in a fully lowered position with the upper slats open and the lower slats in a closed position as shown in FIG. 2.
Figure 5:
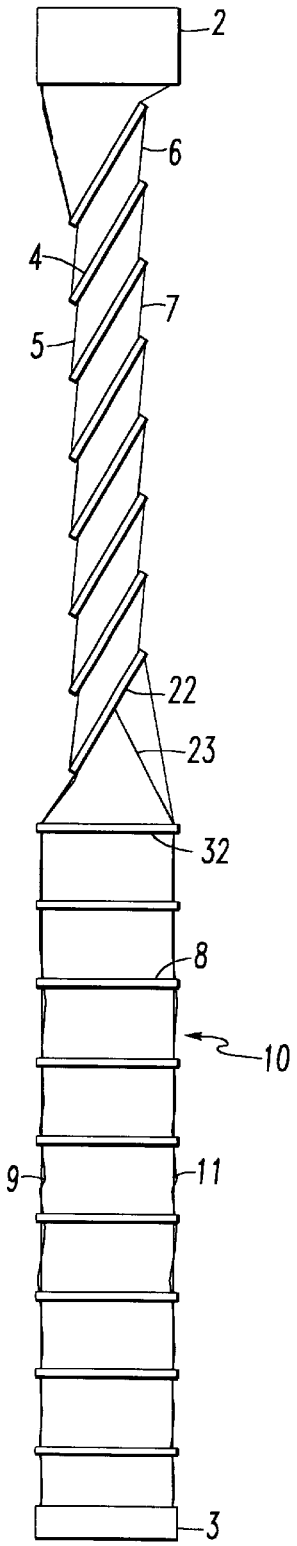
FIG. 5 is an end view similar to FIGS. 3 and 4 showing the blind when it is in a fully lowered position with the upper slats in a closed position front edges down and the lower slats in an open position.

The blind is raised and lowered in the same manner as a conventional venetian type blind. The tilt mechanism in the headrail also is operated in the conventional way. Activating the tilt mechanism will move the front rail 5 of each upper ladder 6 relative to the rear rail 7 causing the upper slats and the pivot slat to tilt. Since the lower ladders are pivotably attached to the pivot slat such movement of the upper ladders will not cause the lower slats to tilt. To tilt the lower slats one simply turns the tilt slat or the bottomrail to cause the front rails of the lower ladders to move relative to the rear rails of the lower ladders. In this way the lower slats can be moved to a different position from the upper slats. This is exemplified by comparing FIGS. 3, 4 and 5. In FIG. 3 all the slats are in a horizontal, open position. By turning the tilt slat 32 the lower slats 8 are tilted to a closed position shown in FIG. 4 while the upper slats 4 remain open. Operating the tilt mechanism when all the slats are horizontal causes the upper slats 4 to close while the lower slats 8 remain open as shown in FIG. 5.

Although we have shown and described certain present preferred embodiments of our venetian blind it should be distinctly understood that the invention is not limited thereto but may be variously embodied within the scope of the following claims.

We claim:

1. A venetian type blind comprising:

a. a bottomrail;

b. a headrail positioned above the bottomrail;

c. a pivot slat positioned between the headrail and the bottomrail, the pivot slat comprised of:

i. an elongated pivot slat body having a front edge and a rear edge;

ii. a plurality of upper ladder connectors attached to the elongated pivot slat body the connectors positioned and configured to receive an upper ladder front rail adjacent the front edge of the elongated pivot slat body and an upper ladder rear rail adjacent the rear edge of the elongated pivot slat body; and iii. a plurality of lower ladder tilt members each tilt member connected to the elongated pivot slat body and positioned below the elongated pivot slat body and between the front edge and the rear edge of the elongated pivot slat body;

d. a plurality of upper ladders each upper ladder having a front rail and a rear rail and extending from the headrail, each rail of an upper ladder attached to an upper ladder connector;

e. a tilt slat positioned immediately below the pivot slat, the tilt slat comprised of:

i. an elongated tilt slat body having a front edge and a rear edge;

ii. a plurality of lower ladder connectors attached to the elongated tilt slat body the connectors positioned and configured to receive a lower ladder front rail adjacent the front edge of the elongated tilt slat body and a lower ladder rear rail adjacent the rear edge of the elongated tilt slat body;

f. at least one pivot cord running from each lower ladder connector to a said lower ladder tilt member;

g. a plurality of lower ladders extending from the bottomrail toward the headrail each lower ladder attached to a lower ladder connector, h. a plurality of upper slats carried on the upper ladders i. a plurality of lower slats carried on the lower ladders;

j. at least two lift cords each having a terminal end attached to the bottomrail, running past the lower slats and the upper slats and passing into the headrail; and k. wherein rotation of the tilt slat causes corresponding rotation of the bottom rail.

2. The venetian type blind of claim 1 wherein the lower ladder tilt members are rods which are substantially parallel to the front edge and the rear edge of the elongated pivot slat body thereby forming the at least one pivot cord.

3. The venetian blind of claim 1 wherein a portion of the front rail of one lower ladder passes through a first lower ladder connector adjacent the front edge of the elongated tilt slat body, over the pivot member and is attached to a second lower ladder connector adjacent the rear edge of the elongated tilt slat body thereby forming a second one of the at least one pivot cord.

4. A venetian type blind comprising:

a. a bottomrail;

b. a headrail positioned above the bottomrail;

c. a pivot slat positioned between the headrail and the bottomrail, the pivot slat comprised of:

i. an elongated pivot slat body having a front edge and a rear edge;

ii. a plurality of upper ladder connectors attached to the elongated pivot slat body the connectors positioned and configured to receive an upper ladder front rail adjacent the front edge of the elongated pivot slat body and an upper ladder rear rail adjacent the rear edge of the elongated pivot slat body; and iii. a plurality of lower ladder tilt members each tilt member connected to the elongated pivot slat body and positioned between the front edge and the rear edge of the elongated pivot slat body;

d. a plurality of upper ladders each upper ladder having a front rail and a rear rail and extending from the headrail, each rail of an upper ladder attached to an upper ladder connector;

e. a tilt slat positioned immediately below the pivot slat, the tilt slat comprised of.

i. an elongated tilt slat body having a front edge and a rear edge; and ii. a plurality of lower ladder connectors attached to the elongated tilt slat body the connectors positioned and configured to receive a lower ladder front rail adjacent the front edge of the elongated tilt slat body and a lower ladder rear rail adjacent the rear edge of the elongated tilt slat body;

f. at least one pivot cord running from each lower ladder connector to a lower ladder tilt member;

g. a plurality of lower ladders extending from the bottomrail toward the headrail each lower ladder attached to a lower ladder connector;

h. a plurality of upper slats carried on the upper ladders;

i. a plurality of lower slats carried on the lower ladders;

j. at least two lift cords attached to the bottomrail, running past the lower slats and the upper slats and passing into the headrail;

k. a portion of the front rail of one lower ladder passing through a first lower ladder connector adjacent the front edge of the elongated tilt slat body, over the pivot member and being attached to a second lower ladder connector adjacent the rear edge of the elongated tilt slat body thereby forming a second one of the at least one pivot cord; and m. wherein the rear rail of the one lower ladder passes through the second lower ladder connector adjacent the rear edge of the elongated tilt slat body, over the pivot member and is attached to the first lower ladder connector adjacent the front edge of the elongated tilt slat body, thereby forming a second one of the at least one pivot cord.

5. The venetian blind of claim 3 wherein the first lower ladder connector and the second lower ladder connector are portions of a one-piece body attached to the tilt slat.

6. The venetian type blind of claim 1 wherein the slats are symmetrical to a plane passing from the front edge to the back edge of the slats.

7. The venetian type blind of claim 1 wherein the slats are one of wood, aluminum and plastic.

8. The venetian type blind of claim 1 also comprising a link between each upper ladder rail and each upper ladder connector.

9. The venetian type blind of claim 1 wherein the upper ladders and the lower ladders are cord type ladders.

10. The venetian type blind of claim 1 wherein the upper slats, the lower slats, the pivot slat and the tilt slat have holes through which one of the lift cords passes.

11. The venetian type blind of claim 1 wherein the upper slats, the lower slats, the pivot slat and the tilt slat have slots through which one of the lift cords passes.

12. The venetian type blind of claim 1 wherein the slats are symmetrical to a plane passing between the front edge of the slats and the rear edge of the slats.

13. The venetian type blind of claim 1 wherein each lower ladder pivot member is a portion of a unitary body that also contains at least one of the plurality of upper body connectors.

14. A venetian type blind comrprising:

a. a bottomrail;

b. a headrail positioned above the bottomrail;

c. a pivot slat positioned between the headrail and the bottomrail, the pivot slat comprised of:

i. an elongated pivot slat body having a front edge and a rear edge;

ii. a plurality of upper ladder connectors attached to the elongated pivot slat body the connectors positioned and configured to receive an upper ladder front rail adjacent the front edge of the elongated pivot slat body and an upper ladder rear rail adjacent the rear edge of the elongated pivot slat body; and iii. a pluarlity of lower ladder tilt members each tilt member connected to the elongated pivot slat body and positioned between the front edge and the rear edge of the elongated pivot slat body;

d. a plurality of upper ladders each upper ladder having a front rail and a rear rail and extending from the headrail, each rail of an upper ladder attached to an upper ladder connector;

e. a tilt slat positioned immediately below the pivot slat, the tilt slat comprised of:

i. an elongated tilt slat body having a front edge and a rear edge; and ii. a plurality of lower ladder connectors attached to the elongated tilt slat body the connectors positioned and configured to receive a lower ladder front rail adjacent the front edge of the elongated tilt slat body and a lower ladder rear rail adjacent the rear edge of the elongated tilt slat body;

f. at least one pivot cord running from each lower ladder connector to a lower ladder tilt member;

g. a plurality of lower ladders extending from the bottomrail toward the headrail each lower ladder attached to a lower ladder connector, h. a plurality of upper slats carried on the upper ladders, i. a plurality of lower slats carried on the lower ladders, j. at least two lift cords attached to the bottomrail, running past the lower slats and the upper slats and passing into the headrail; and k. wherein the at least one pivot cord is a belt having a plurality of detents.

15. The venetian type blind of claim 1 wherein the at least one pivot cord is a portion of at least one rung of the lower ladder.

* * * * *